US008701828B1

(12) United States Patent
Matthew

(10) Patent No.: US 8,701,828 B1
(45) **Date of Patent: *Apr. 22, 2014**

(54) STABLE STEPLADDER WITH UTILITY TRAY

(76) Inventor: Martin S Matthew, Marryville, TN (US)

( * ) Notice: Subject to any disclaimer, the term of this patent is extended or adjusted under 35 U.S.C. 154(b) by 129 days.

This patent is subject to a terminal disclaimer.

(21) Appl. No.: 12/806,080

(22) Filed: Aug. 5, 2010

(51) Int. Cl.
*E06C 5/32* (2006.01)

(52) U.S. Cl.
USPC ..... 182/129; 182/172

(58) Field of Classification Search
USPC ..... 182/106, 172, 165, 129, 60; D25/64, D25/68; 248/210, 211, 238
See application file for complete search history.

(56) References Cited

U.S. PATENT DOCUMENTS

| | | | | | |
|---|---|---|---|---|---|
| 639,603 | A | * | 12/1899 | Nelson | 182/29 |
| 1,134,491 | A | * | 4/1915 | Savage | 182/172 |
| 1,251,761 | A | | 1/1918 | Enke | |
| 1,385,319 | A | * | 7/1921 | Enke | 182/172 |
| 2,167,157 | A | | 7/1937 | Muehlberg | |
| 2,381,154 | A | | 5/1944 | Fowler | |
| 3,568,798 | A | * | 3/1971 | Pierce | 182/172 |
| 3,692,143 | A | * | 9/1972 | Kummerlin et al. | 182/24 |
| 3,822,846 | A | * | 7/1974 | Jesionowski | 248/210 |
| 4,011,926 | A | | 3/1977 | Larson | |
| 4,147,231 | A | * | 4/1979 | Chantler et al. | 182/172 |
| 4,244,446 | A | | 1/1981 | Mair | |
| 4,418,793 | A | | 12/1983 | Brent | |
| 4,515,242 | A | | 5/1985 | LaChance | |
| 4,589,521 | A | * | 5/1986 | Finster et al. | 182/129 |
| 4,641,729 | A | * | 2/1987 | Beck et al. | 182/172 |
| 4,723,629 | A | | 2/1988 | Vanden Hoek | |
| 4,730,802 | A | * | 3/1988 | Chatham et al. | 248/238 |
| 4,798,262 | A | | 1/1989 | Margolies | |
| 4,824,060 | A | * | 4/1989 | Korda | 248/210 |
| 4,926,968 | A | * | 5/1990 | Schumer | 182/172 |
| 4,949,925 | A | * | 8/1990 | Gorecki | 248/238 |
| 4,964,488 | A | | 10/1990 | Stewart | |
| 5,052,581 | A | | 10/1991 | Christ | |
| 5,058,707 | A | * | 10/1991 | Waid | 182/120 |
| 5,074,377 | A | * | 12/1991 | Krause | 182/167 |
| 5,106,045 | A | * | 4/1992 | Bezotte | 248/210 |
| 5,148,891 | A | | 9/1992 | McConnell | |
| 5,590,739 | A | * | 1/1997 | High et al. | 182/169 |
| 5,915,498 | A | | 6/1999 | Figliuzzi | |

(Continued)

FOREIGN PATENT DOCUMENTS

| | | | |
|---|---|---|---|
| GB | 2400397 | A * | 10/2004 |
| GB | 2428068 | A | 1/2007 |

*Primary Examiner* — Charles A Fox
*Assistant Examiner* — Kristine Florio
(74) *Attorney, Agent, or Firm* — Dennis W. Beech

(57) ABSTRACT

The present invention is used on stepladders that are structured to provide improved lateral stability, step support and equipment/supplies support for stepladder users. The stepladder may have a step element rotatably attached to a support element at a top platform or a first step element rotatably attached to a second step element adjacent a top step. A hinged strut may be attached at opposed ends between the opposed elements intermediate the ladder top and the ladder base. A plurality of steps may be spaced apart and attached between step rails of step elements. A lateral support leg may be rotatably attached at a top end to each of the step rails intermediate a second step and a third step from the ladder top and a hinged leg strut may be attached at opposed ends between each of the support rails and lateral support legs.

13 Claims, 5 Drawing Sheets

(56) References Cited

U.S. PATENT DOCUMENTS

| | | | | |
|---|---|---|---|---|
| 6,148,958 | A | 11/2000 | Ahl | |
| 6,799,660 | B1 * | 10/2004 | Crawford | 182/200 |
| 7,017,711 | B1 * | 3/2006 | Ali | 182/201 |
| D560,001 | S * | 1/2008 | Moss et al. | D25/68 |
| 2002/0074187 | A1 * | 6/2002 | Bendle et al. | 182/172 |
| 2004/0245045 | A1 * | 12/2004 | Shai | 182/17 |
| 2005/0029042 | A1 * | 2/2005 | Latimer et al. | 182/77 |
| 2005/0121261 | A1 * | 6/2005 | Moss et al. | 182/165 |
| 2005/0127254 | A1 * | 6/2005 | Scott et al. | 248/188 |
| 2005/0194214 | A1 | 9/2005 | Royce | |
| 2006/0137937 | A1 * | 6/2006 | Pratt | 182/129 |
| 2009/0229918 | A1 * | 9/2009 | Moss et al. | 182/129 |
| 2009/0250294 | A1 * | 10/2009 | Byers | 182/129 |
| 2010/0096215 | A1 * | 4/2010 | Mcfarlane | 182/106 |
| 2010/0155177 | A1 * | 6/2010 | Tydings, III | 182/129 |
| 2011/0079467 | A1 * | 4/2011 | Mares | 182/129 |

* cited by examiner

STABLE STEPLADDER WITH UTILITY TRAY

BACKGROUND OF THE INVENTION

This invention relates to stepladder structure to improve ladder lateral stability and provide utility devices adjacent the top of the ladder. The new ladder structure includes four deployable lateral support legs and at least one utility support tray attached adjacent the top of the ladder.

The concept of increasing a stepladder total width at the base of the ladder may be known. There are various issued patents that disclose and discuss that this feature has been established as an important element for ladder stability. Likewise there are a variety of disclosures and issued patents with lateral stability elements. However, the various advancements in this field of the art still show there is a need for improvement of the structure of a stepladder for stability that may be a combination of ladder strength as well as the structure of deployable lateral support legs, width of ladder rungs and availability of utility support trays. A properly structured ladder may allow use of existing ladder transport equipment, storage facilities, shipping space and other ladder accessories.

SUMMARY OF THE INVENTION

The present invention is directed to stepladders that are structured to provide improved lateral stability, step support and equipment/supplies support for stepladder users. The stepladder may have a step element rotatably attached to a support element at a top platform or a first step element rotatably attached to a second step element adjacent a top step. A hinged strut may be attached at opposed ends between the opposed elements intermediate the ladder top and the ladder base. A plurality of steps may be spaced apart and attached between step rails of step elements. A lateral support leg may be rotatably attached at a top end to each of the step rails intermediate a second step and a third step from the ladder top and a hinged leg strut may be attached at opposed ends between each of the support rails and lateral support legs.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 2:
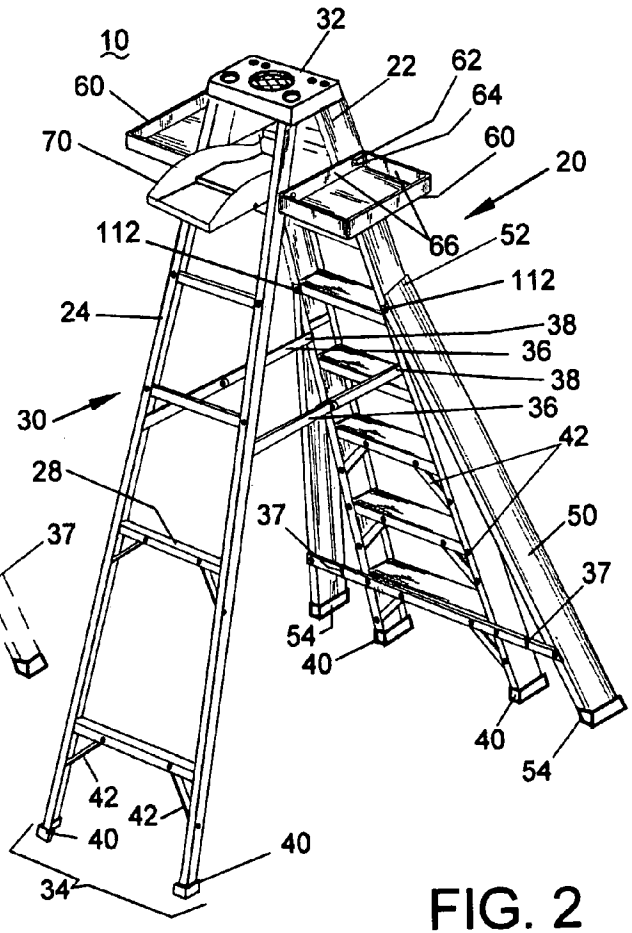
FIG. 2 illustrates a rear perspective elevation view of a stepladder according to an embodiment of the invention.
Figure 1:
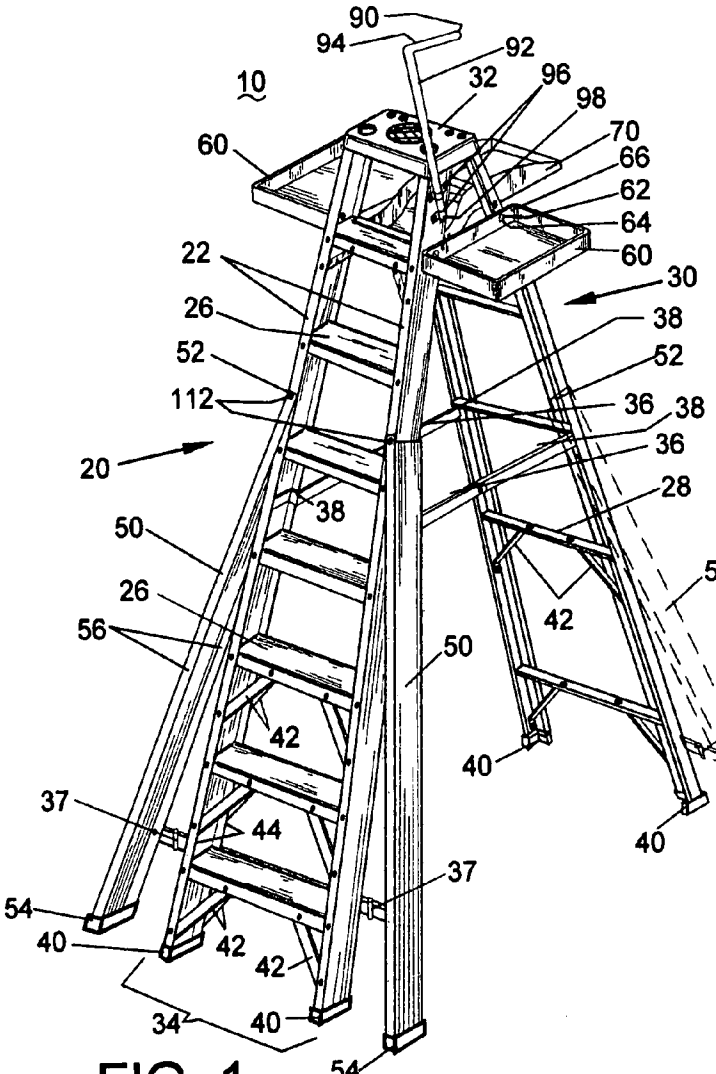
FIG. 1 illustrates a front perspective elevation view of a stepladder according to an embodiment of the invention.
Figure 4:
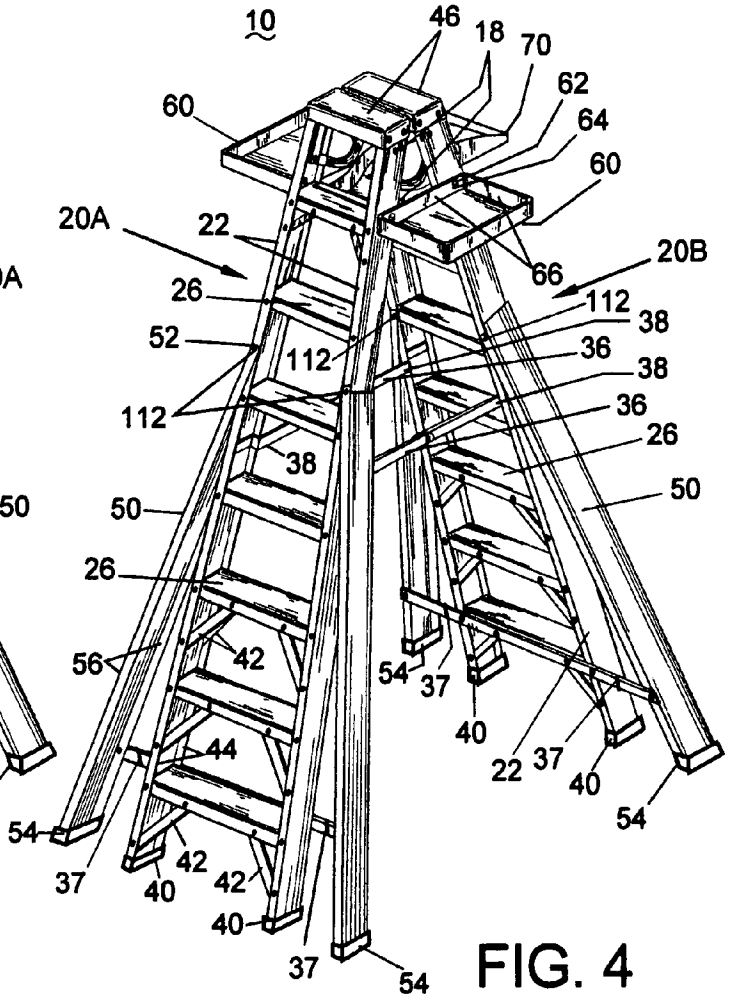
FIG. 4 illustrates a reverse perspective elevation view of FIG. 3 according to an embodiment of the invention.
Figure 3:
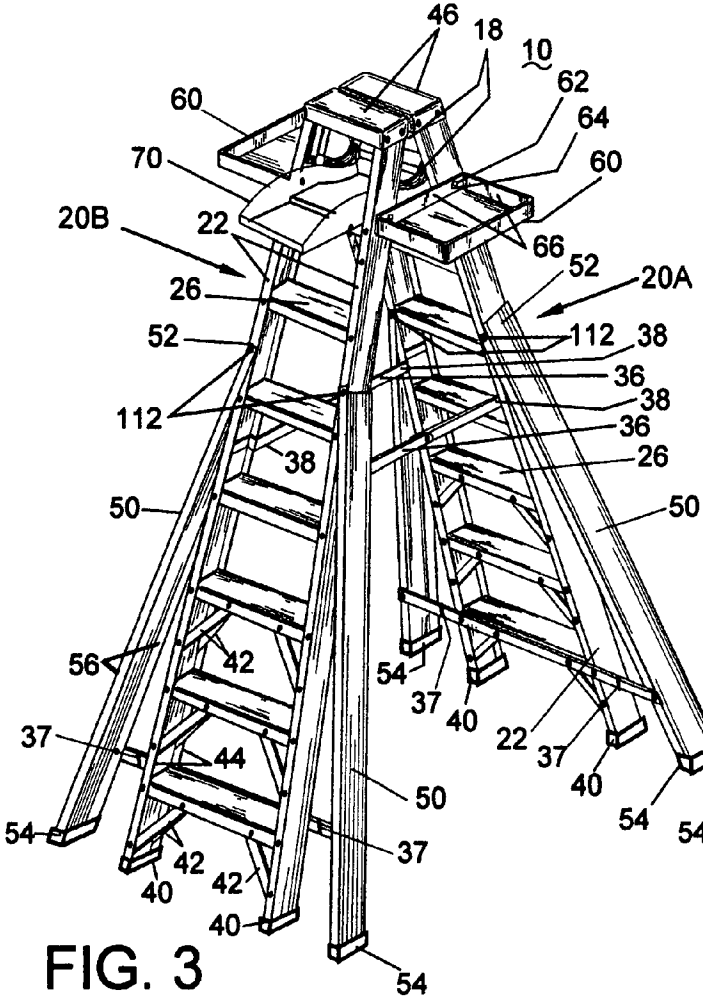
FIG. 3 illustrates a front perspective elevation view of a two step element stepladder according to an embodiment of the invention.
Figure 7:
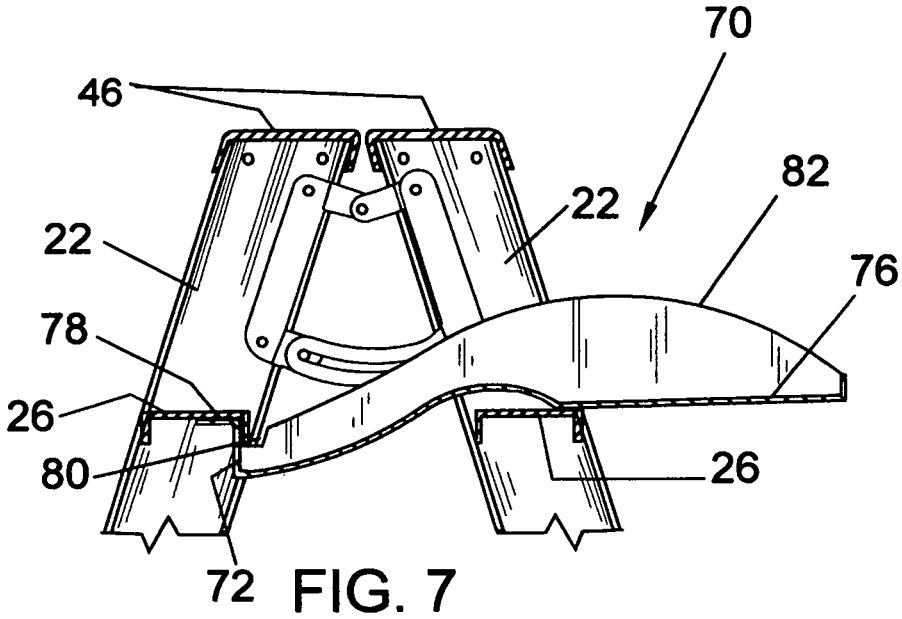
FIG. 7 illustrates a side partial section view of a ladder top with extended tray according to an embodiment of the invention.
Figure 6:
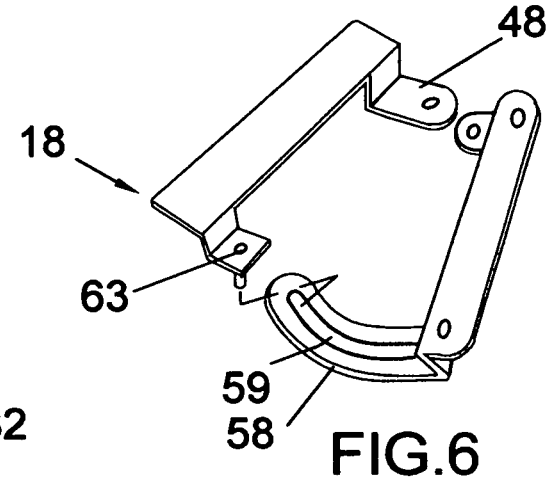
FIG. 6 illustrates a side view of a hinge and strut combination according to an embodiment of the invention.
Figure 5:
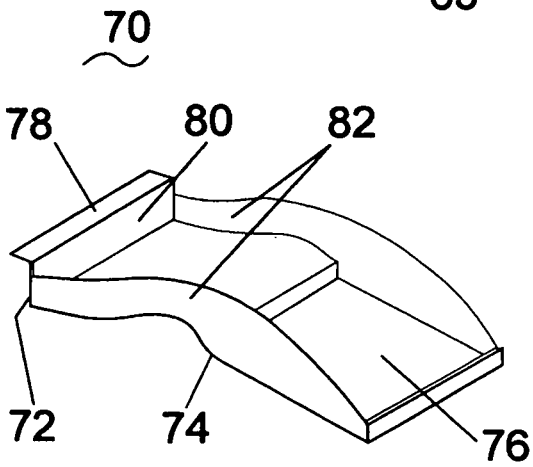
FIG. 5 illustrates a top perspective view of an extended tray according to an embodiment of the invention.

Referring to FIGS. 1 and 2, a stepladder 10 may have a step element 20 and a support element 30 rotatably attached at a top platform 32 and connected intermediate to the top platform 32 and the ladder base 34 by a hinged strut 36 attached at opposed ends 38 to each adjacent step rail 22 and support rail 24. The step rails 22 may have steps 26 attached between the two step rails 22 spaced apart a distance selected for climbing use of the ladder 10. The steps 26 may have a width of 4½ inches from the front edge to the back edge of a step 26 to allow stable support of a user's feet.

The support rails 24 may have horizontal support members 28 attached between the two support rails 24 spaced apart a distance selected for structural support of the ladder 10. Angular braces 42 may be attached between one or more of the steps 26 and the step rails 22 and between the support members 28 and the support rails 24 to strengthen the ladder 10. The angular braces 42 may be attached in pairs at each side wall 44 of the rails 22, 24 and steps 26 or support member 28.

Deployable lateral support legs 50 may be rotatably attached at a top end 52 by a rotatable fastener 112 to each of the step rails 22 and lateral legs 51 may be attached at a top end 49 by a fastener 112 to each of the support rails 24. A hinged strut leg 37 may be attached at opposed ends 38 between each of a step rail 22, or a support rail 24 and a lateral support leg 50 or a lateral leg 51. When a leg 50 is deployed the hinged leg strut 37 may support the foot 54 or bottom end of the leg 50 a predetermined distance from the bottom end 40 of a rail 22, 24. The legs 50 may be structured as "U" shape or open channel beams with side walls 56 spaced apart sufficiently to allow the legs 50 when moved against a rail 22, 24 to overlap the rail 22, 24 with the side walls 56 positioned on the rail 22, 24 side walls 44. When the legs 50 are in the stowed position the ladder 10 step and support members 20, 30 may present a narrow profile similar to standard stepladders. The stepladder 10 with stowed legs 50 may be stored, transported and shipped using existing stepladder handling equipment.

The legs 50 may be attached intermediate the second and third step of the step element 20 to allow optimal stability support for the stepladder 10 when the legs 50 may be deployed. General practice for safe use of a stepladder may be to not climb the ladder higher than the second or third step from the top platform 32. Experiments with stepladders 10 have demonstrated that a reasonable separation distance between the step rail 22 bottom end 40 and the leg 50 foot 54 for ladder stability may be to approximately double the width of the base 34. An equivalent attachment distance from the top 32 and for the separation distance between the bottom end 40 and foot 54 for the support rails 24 when used with legs 50 also may improve ladder 10 stability.

For additional safe use of the stepladder 10, utility trays 60 may be attached adjacent to the top platform 32 in position to hold tools, supplies, paint and the like for ease of access to a user of the stepladder 10. Trays 60 may be attached by slidable engagement of one or more slots 64 formed in a side 66 of the tray 60 with capped lugs 62 that are attached to the upper portion of the rails 22, 24. The tray 60 may have four sides 66 that may be 2 inches high to retain elements in the tray 60. The tray 60 may also be structured as a paint tray to hold paint for a user to apply paint to a paint roller (not shown). The tray 60 may have a width to extend outwardly from a side of the ladder 10 a distance approximately equal to the deployed distance between a bottom end 40 and foot 54 to allow placement of a ladder 10 abut a vertical structure.

Referring to FIGS. 1, 2, 5 and 7, an extending tray 70 may be structured to have a step end 72 that can be retained under a step 26 and a tray end 74 positionable on a support member 28 to position a tray pan 76 outwardly from the ladder 10 opposite a user climbing side. The extending tray 70 may have an elongated flange 78 on a back bar 80 that is attached to two beam members 82 that extend generally orthogonally from the back bar 80 to the tray end 74 to support the tray pan 76.

Referring to FIGS. 3, 4, 6 and 7 the stepladder 10 may have a first step element 20A and a second step element 20B rotatably attached at a top step 46. In this configuration there is no support element 30. The step elements 20A, 20B may be the same structure as that described for step element 20 with step element 20A and step element 20B being rotated 180 degrees relative to each other. A hinge 48 may be used to attach each top step 46. A strut 58 having a slot 59 may be attached at one end to each step rail 22 of one step element 20 with the slot 59 engage with a capped lug 63 attached to each step rail 22 of the second step element 20. The hinge and strut combination 18 may improve stability of the abutting top steps 46. Use of a first step element 20A and second step element 20B may allow more versatile use of the stepladder 10. To the extent the step element 20 may have stronger structural elements than the support element 30, the two step element 20A, 20B structure may have additional stability.

Evaluation of the stepladder 10 structure, particularly the dual step element ladder 20A, 20B, by medical professionals found that the generally rigid structure with the long support legs 50 and the wide steps 26 allowed better balance with less stress to the entire muscular-skeletal system. Unnecessary stress applied to the body can in turn cause conditions such as neck pain, upper back pain, pain across the shoulders, middle back pain, lower back pain, hip pain, knee pain and foot/ankle pain. The added stress and strains can also cause the body to fatigue more quickly, which in turn can lead to both physical and mental fatigue and impairment. The stability elements in the structure of the stepladder 10 should reduce these stress issues and the chance of injury for ladder users.

Figure 9:
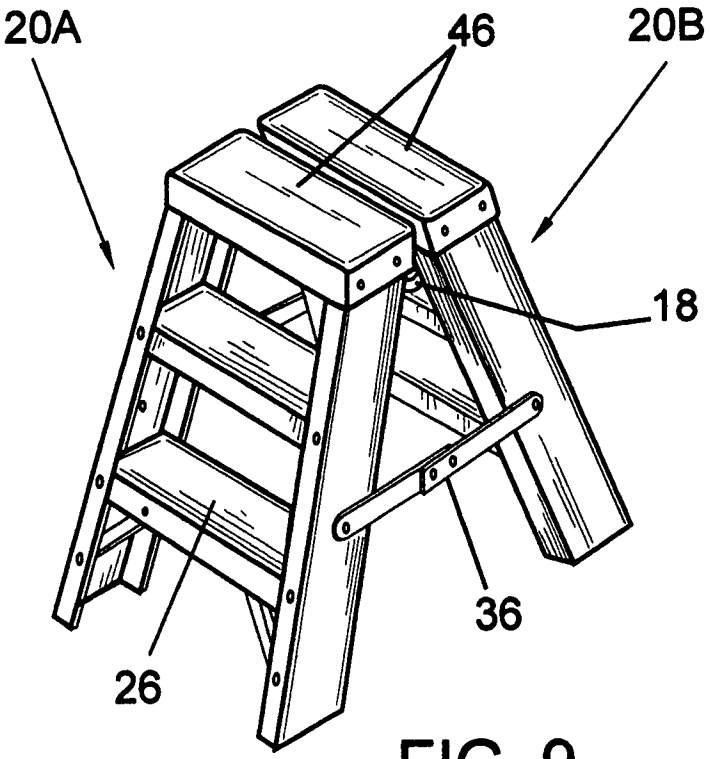
FIG. 9 illustrates a reverse perspective elevation view of FIG. 8 except for elements 90 through 98 according to an embodiment of the invention.
Figure 8:
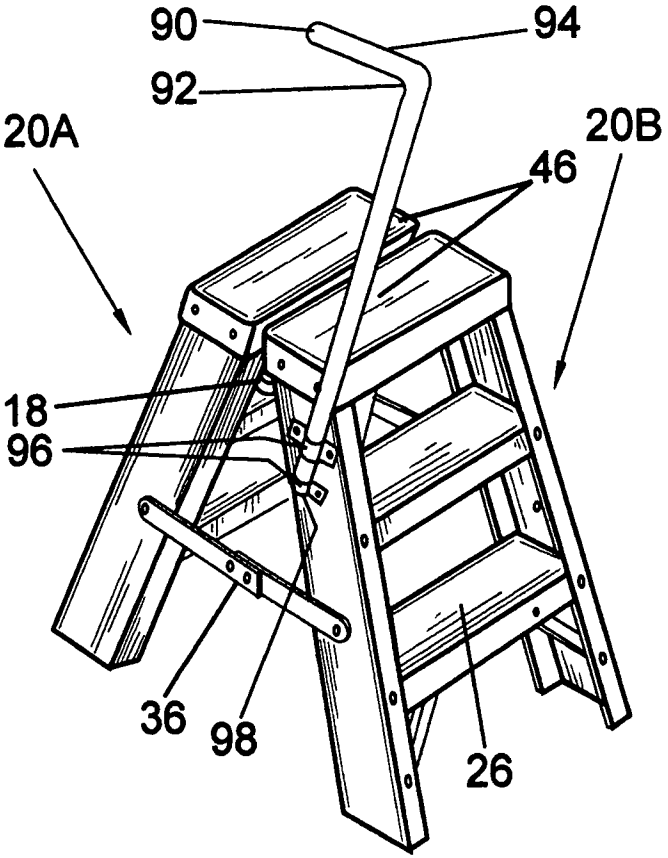
FIG. 8 illustrates a front perspective elevation view of a shortened configuration of a stepladder according to an embodiment of the invention.
Figure 10:
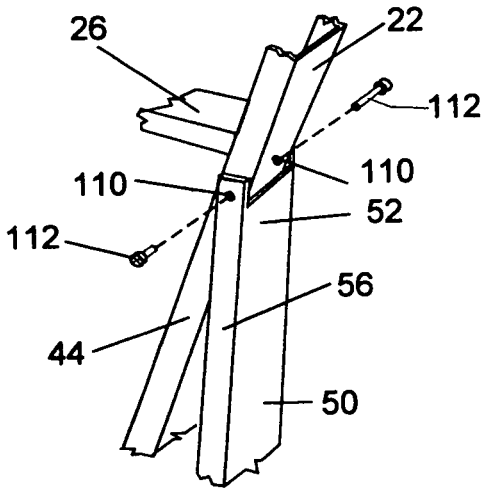
FIG. 10 illustrates a partial perspective view of a stepladder step rail with a lateral support leg attached according to an embodiment of the invention.

Referring to FIGS. 8 and 9, the stepladder 10 may be constructed with various heights or rail 22, 24 lengths, for example, 6 foot, 12 foot and the like. A configuration of the two step element 20A, 20B structure may be constructed with a low height of perhaps 3 feet and may not included the lateral support legs 50. Use of the two step element 20A, 20B configuration and the wide steps of 4½ inches may provide a sturdy, stable stand on which a user may stand on the abutting top steps 46.

Referring to FIGS. 1 and 8, a safety handle 90 may be used with the stepladder 10 to allow a user a structure adjacent the top of stepladder 10 to grip for stability when standing near the top or on a short ladder 10 when standing on the top step 44 46. The safety handle 90 may have an elongated shaft 92 that may be slidably inserted in clamps 96 that are attached to a step rail 22. The lower clamp 96 may have a stop element 98. There may be an angular bar 94 that may be attached approximately orthogonally to the top of the elongated shaft 92 for ease in gripping the safety handle.

While the invention has been particularly shown and described with respect to the illustrated embodiments thereof, it will be understood by those skilled in the art that the foregoing and other changes in form and details may be made therein without departing from the spirit and scope of the invention.

I claim:

1. A stepladder comprising:

a first step element and a second step element have a rotatable attachment adjacent a top step of each of said first step element and said second step element;

a hinged strut is attached at opposed ends to each adjacent step rail of each opposed said first step element and said second step element intermediate said top steps and a ladder base;

a plurality of steps spaced apart and attached between said step rails of said first step element and said step rails of said second step element;

a lateral support leg rotatably attached at a top end by a rotatable fastener positioned in each side wall of said lateral support leg and in each side wall of each of said step rails of said first step element intermediate a second step and a third step from said top steps and a hinged leg strut is attached at opposed ends between each of said step rails of said first step element and each rotatably attached said lateral support leg; and wherein a capped lug is attached adjacent said top step on each of two opposed of said step rails, and a utility tray having four side walls with one of said side walls having at least two slots formed therein for engagement with said capped lugs is disposed on the stepladder.

2. The stepladder as in claim 1 wherein said second step element has a lateral support leg rotatably attached at a top end by a rotatable fastener positioned in each side wall and cooperatively positioned in each side wall of each of said step rails of said second step element intermediate a second step and a third step from said top step and a hinged leg strut is attached at opposed ends between each of said step rails of said second step element and each rotatably attached said lateral support leg.

3. The stepladder as in claim 1 wherein said rotatable attachment is a hinge and strut combination attached between adjacent step rails adjacent said top steps with a hinge spaced apart from a strut that has a slot and is positioned below said hinge wherein said slot is engaged with a cap lug attached below said hinge.

4. A stepladder comprising:

a step element and a support element each rotatably attached in opposed relationship at a top platform wherein said step element has two spaced apart step rails with a plurality of steps spaced apart and attached therebetween, and said support element has two spaced apart support rails with at least one support member attached therebetween;

a hinged strut is attached between each step rail and each opposed support rail intermediate said top platform and a ladder base;

a lateral support leg rotatably attached at a top end by a rotatable fastener positioned in each side wall of said lateral support leg and in each side wall of each of said step rails intermediate a second step and a third step from said top platform; and a hinged leg strut is attached between each step rail and each opposed lateral support leg; and wherein a first capped lug is attached adjacent said top platform on said step rail and a second capped lug is attached adjacent said top platform on said support rail; and a utility tray having four side walls with one of said side walls having at least two slots formed therein for engagement with said capped lugs is disposed on the stepladder.

5. The stepladder as in claim 4 wherein each of said plurality of steps are approximately 4½ inches wide from a front edge to a back edge.

6. The stepladder as in claim 4 wherein when said lateral support legs are deployed a foot end of each is spaced apart from its attached step rail one half the width of the distance between a bottom end of each of said two step rails.

7. The stepladder as in claim 4 wherein said lateral support legs are a U-shape channel beam structure with opposed side walls spaced apart sufficiently to allow overlap of said lateral support legs on said step rails.

8. The stepladder as in claim 4 wherein an angular brace is attached between a side wall in a lower portion of one of said two step rails and at least one of said steps.

9. The stepladder as in claim 4 wherein said support element has a plurality of support members spaced apart and attached between said support rails.

10. The stepladder as in claim 4 wherein a lateral leg is rotatably attached at a top end to each of said support rails at relatively the same height as said lateral support legs are attached to said step rails and a lateral hinged leg strut is attached at opposed ends between each of said support rails and said lateral legs.

11. The stepladder as in claim 4 wherein said utility tray is structured as a paint roller tray.

12. The stepladder as in claim 4 wherein said utility tray has a width to extend perpendicularly from the plane of said first capped lug and said second capped lug from said step rail a distance approximately equal to the separation distance between a bottom end of said step rail and a foot of said lateral support leg when deployed.

13. The stepladder as in claim 4 wherein an extended tray has a step end with an elongated flange on a back bar that is attached to two beam members that extend generally orthogonally from said back bar to a tray end that has a tray pan attached wherein said two beam members are shaped to position said step end under one of said plurality of steps and said tray end on a support member.

* * * * *